United States Patent [19]

Stayner

[11] Patent Number: 4,837,999

[45] Date of Patent: Jun. 13, 1989

[54] PREFABRICATED BUILDING PANEL

[76] Inventor: Vance Stayner, 139 Mona Dr., Sugar Grove, Ill. 60554

[21] Appl. No.: 134,466

[22] Filed: Dec. 17, 1987

[51] Int. Cl.[4] ..... E04C 1/00

[52] U.S. Cl. ..... 52/309.11; 52/793; 52/795; 52/809

[58] Field of Search ..... 52/309.11, 309.9, 795, 52/801, 809, 817, 793, 309.7, 309.1

[56] References Cited

U.S. PATENT DOCUMENTS

| | | | |
|---|---|---|---|
| 2,029,352 | 2/1936 | Beckwith | 52/809 X |
| 4,265,067 | 5/1981 | Palmer | 52/809 X |
| 4,495,741 | 1/1985 | Pasiecznik | 52/404 |
| 4,539,785 | 9/1985 | Overbo | 52/309.1 |

FOREIGN PATENT DOCUMENTS

| | | | |
|---|---|---|---|
| 1954690 | 5/1971 | Fed. Rep. of Germany | 52/795 |
| 1262605 | 12/1961 | France | 52/795 |
| 1362522 | 4/1964 | France | 52/795 |

*Primary Examiner*—Carl D. Friedman

*Attorney, Agent, or Firm*—Irving Faber

[57] ABSTRACT

An improved prefabricated building panel suitable for use as a wall and/or a roof panel for buildings said panel having a center core with an inner and outer skin coupled thereto by means of a pultrusion.

9 Claims, 3 Drawing Sheets

PREFABRICATED BUILDING PANEL

BACKGROUND OF THE INVENTION

Prefabricated wall and roof panels having an inner and outer skin coupled to a center core are known in the art. The center core may be of styrofoam or of various plastic materials well-known in the art. In addition to styrofoam, polyisocyanate or polyurethane foam has been used as a core between inner and outer skins such as corrugated metal panels, blandix, wallboard, etc. The difficulty with using polyurethane and/or polyisocyanate or other similar type plastic materials, is that upon combustion they give off toxic gasses, which may be fatal to the occupants of the building. When the inner and outer skins are coupled directly to the center core by means of mechanical fastners, there will be a loss of "R" value through the wall since there is a heat transfer through the wall depending on the relative temperatures of the inside and outside of the building. This heat transfer increases the amount of energy needed to either heat or cool the building. If the inner and outer skins are glued to the center core, as it is done in some cases, it becomes expensive because of the amount of labor that is required to form the panel. The building industry is very competitive, especially when it comes to prefabricated wall panels. Therefore, there is a need in the construction industry for a prefabricated wall and/or roof panel that is inexpensive, easy to assemble and install and will not give off toxic fumes in case of a fire and will retain a high "R" value reducing the energy costs to either heat or cool the building.

My invention incorporates a center core having an inner and outer skin of corrugated metal coupled thereto by means of a "C" shaped pultrusion; said pultrusion separating the skins from the center core thereby forming an air envelope between the core and each of the outer and inner skin.

In my preferred embodiment, I use a styrofoam or a non-combustible mineral wool insulation as a center core panel approximately three feet by four feet. A combination of styrofoam and a non-combustible mineral wool insulation may also be used as the center core. A pultrusion in the form of a "C" channel comprising in part materials covered under my U.S. Pat. Nos. 3,920,603, 4,028,134, 4,027,401 and 4,216,136 in combination with fiberglass material, is positioned on the three foot end of the styrofoam center core panel. The pultrusion is formed by methods well-known in the fiberglass industry. A pair of corrugated metal skins are positioned against the "C" channel pultrusion and are coupled thereto by means of screws that run from the skin to the "C" channel and then into the styrofoam center core panel. The skin does not make direct contact with the styrofoam center core panel, but in fact, forms an envelope of air between it and the center core. The envelopes of air on each side between the center core and the skin, temper the air movement which does not occur when the skin is flat against the center core as in the case when the skins are glued directly to the center core. In addition, the double air envelope created by the pultrusion, forms a vapor barrier on each side of the center core, which inhibits moisture from forming on the skins in winter as well as summer. In addition, the pultrusion inhibits the transfer of heat and/or cold between the skins because of the dual air envelopes.

The "C" channel pultrusion creates a thermal break and provides an excellent means for fastening the inner and outer skins to the pultrusion. The pultrusion does not promote fungus nor will it rot as it would if made of wood, nor give off toxic gasses in combustion if made from a plastic material.

In the event of a fire, the "C" channel compartmentalizes the combustion of the center core and confines it between "C" channels thereby localizing it and preventing it from extending to the entire wall. The combustion is contained between the inner and outer skins between the "C" channel pultrusions. In essence, in may preferred embodiment, the pultrusion acts as a firewall every four feet.

BRIEF SUMMARY OF INVENTION

It is an object of my present invention to provide a prefabricated building panel suitable for use as a wall and/or roof panel having an inner and outer skin coupled to a center core.

It is another object of my invention to provide a prefabricated building panel whereby an envelope of air is created between each skin and the center core.

It is a further object of my invention to provide a prefabricated building panel having a pultrusion coupled to the center core; the skins being coupled to the pultrusion and center core.

It is still a further object of my invention to provide a prefabricated building panel that will not give off toxic gasses upon combustion.

It is another object of my invention to provide a prefabricated building panel that will compartmentalize combustion of the center core.

It is still another object of my invention to provide a prefabricated building panel having an envelope of air between the center core and each skin; said air envelopes inhibiting heat transfer between the inner and outer wall.

It is still a further object of my invention to provide a prefabricated building panel having a vapor barrier formed between each skin and the center core, said vapor barrier inhibiting the formation and accumulation of moisture within the panel.

IN THE DRAWINGS

DESCRIPTION OF PREFERRED EMBODIMENT

Figure 1:
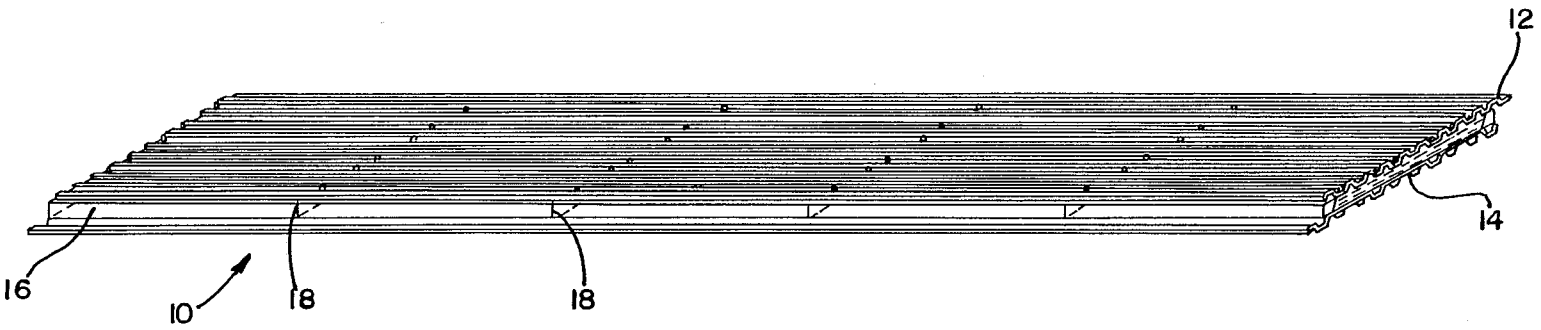
FIG. 1 illustrates a perspective view of my prefabricated building panel.
Figure 4:
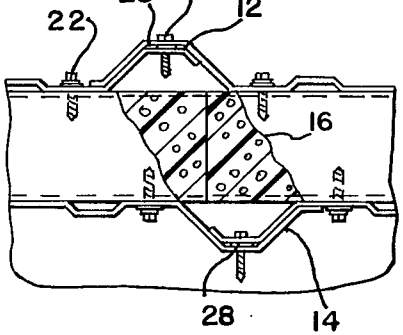
FIG. 4 is a sectional view illustrating the coupling of adjacent building panels.
Figure 3:
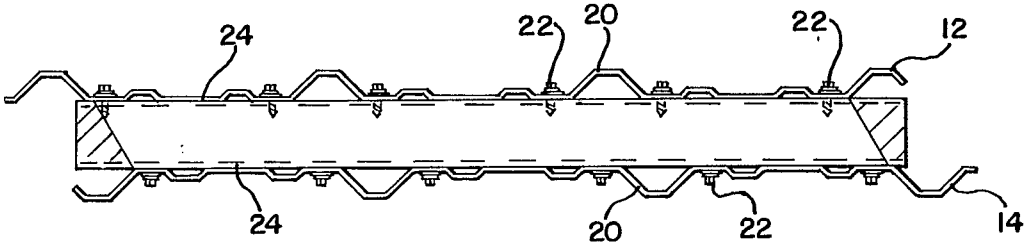
FIG. 3 is a cross sectional view of the panel illustrated in FIG. 1.

This invention relates to a new and useful prefabricated building panel suitable for use as a wall and/or roof panel for buildings.

The wall and/or roof panels 10 comprises an outer skin 12, an inner skin 14, a center core panel 16 positioned between and coupled to the outer skin 12 and inner skin 14 by means of a pultrusion 18. In my preferred embodiment, I use a polystyrene foam such as Styrofoam or a non-combustible mineral insulation or a combination thereof panel as the center core panel 16. However, styrofoam, in combination with a non-combustible mineral wool insulation, may be used as the center core panel 16.

The pultrusion 18 in my preferred embodiment is in the form of a "C" channel; however, it can also be of a "I" beam configuration or a combination thereof. The pultrusion 18 is comprised of fiberglass with or without one or more of my fillers covered under U.S. Pat. Nos. 3,920,603, 4,027,401, 4,028,134 and 4,216,136. It is the combination of fiberglass and my fillers that provides the necessary fire rating for use in the construction of buildings. The "C" channel or "I" beam configuration is formed by extrusion means well-known in the art. In addition to the pultrusion 18 being comprised of fiberglass with or without my aforesaid fillers, it may comprise any other suitable composition suitable for affixing the inner and outer walls.

The outer and inner skins 12, 14 may be of the same material or different materials. In my preferred embodiment, the outer and inner skins are corrugated steel panels having a plurality of corrugations 20. However, the outer skin 12, may be of any material suitable for exterior use and the inner skin 14 can be of any material suitable for indoor use, such as masonite, blandix, drywall, dyrotech, etc.

The styrofoam non-combustible mineral wool insulation center core panel 16 is of the type and nature well-known in the art and are readily available in the market from a number of manufacturers. The thickness of the center core is of a dimension to fit snuggly within the "C" channel pultrusion 18.

The outer skin 12 and inner skin 14 are coupled to the pultrusion 18 and the center core panel 16 by means of a stitching screw 22 well-known in the art, and readily available in the market. Other type screws or fastners may be used in lieu of the stitching screws 22 without departing from the spirit and scope of the invention. When the outer skin 12 and inner skin 14 are coupled to the pultrusion 18, an air envelope or passageway 24 is formed between the center core panel 16 and each of the outer skin 12 and inner skin 14.

The air within the envelope 24 and the air within the corrugations 20 of the corrugated panels act as a chimney. Air circulation is created within the air envelopes 24 and within the corrugations 20 by the warm air rising and the cold air falling. The air circulation within the corrugations 20 and air envelope 24 between the inner skin 14 and outer skin 12 substantially eliminates any heat transfer between the inner and outer skins. Also, it is this circulation of air that inhibits moisture from forming thereby creating a vapor barrier within the air passageways 24.

If desired a decorative panel or plain wallboard or any other type of finished or unfinished panel, not illustrated, may be coupled to the inner wall 14 by fastening it directly to the corrugations 20 by means well-known in the art. Also, a suitable exterior panel may be coupled to the corrugations 20 of the outer skin 12 by means well-known in the art.

My invention can incorporate the use of different interior and exterior skins without departing from the spirit and scope of my invention. The inner and outer skins may be of different materials or of the same depending upon the features desired for the building.

In my preferred embodiment, I have used center core as the center core 16. However, the core can be a combination of polystyrene foam such as styrofoam and a non-combustible mineral wool insulation, both of which are well-known in the art and readily available in the market. The combination of polystyrene foam and the non-combustible mineral wool insulation as a center core 16 increases the fire rating of the wall. This is important especially in areas where the building code requires a high fire rating.

The advantage of having the pultrusion 18 made of fiberglass in combination with one or more of my patented fillers is that it provides a thermal break that inhibits the transmitting of heat and/or cold between the inner and outer skins as well as providing excellent means for fastening the skins thereto and hence to the center core 16. If a metal pultrusion were used, using metal screws to fasten the skins to thereto and to the center core the insulating value or "R" value of the panel 10 would be compromised in that an accellerated heat transfer would occur between the outer and inner skins or vice-versa.

If wood were used in lieu of the pultrusion 18, moisture would accumulate and would rot the wood. Also, in the case of a fire, wood will burn.

The fiberglass pultrusion 18 compartmentalizes any combustion of the foam between pultrusions and keeps any combustion between the inner and outer skins 14 and 12 respectively thereby localizing any combustion. The pultrusion thereby acts essentially as a firewall.

Figure 2:
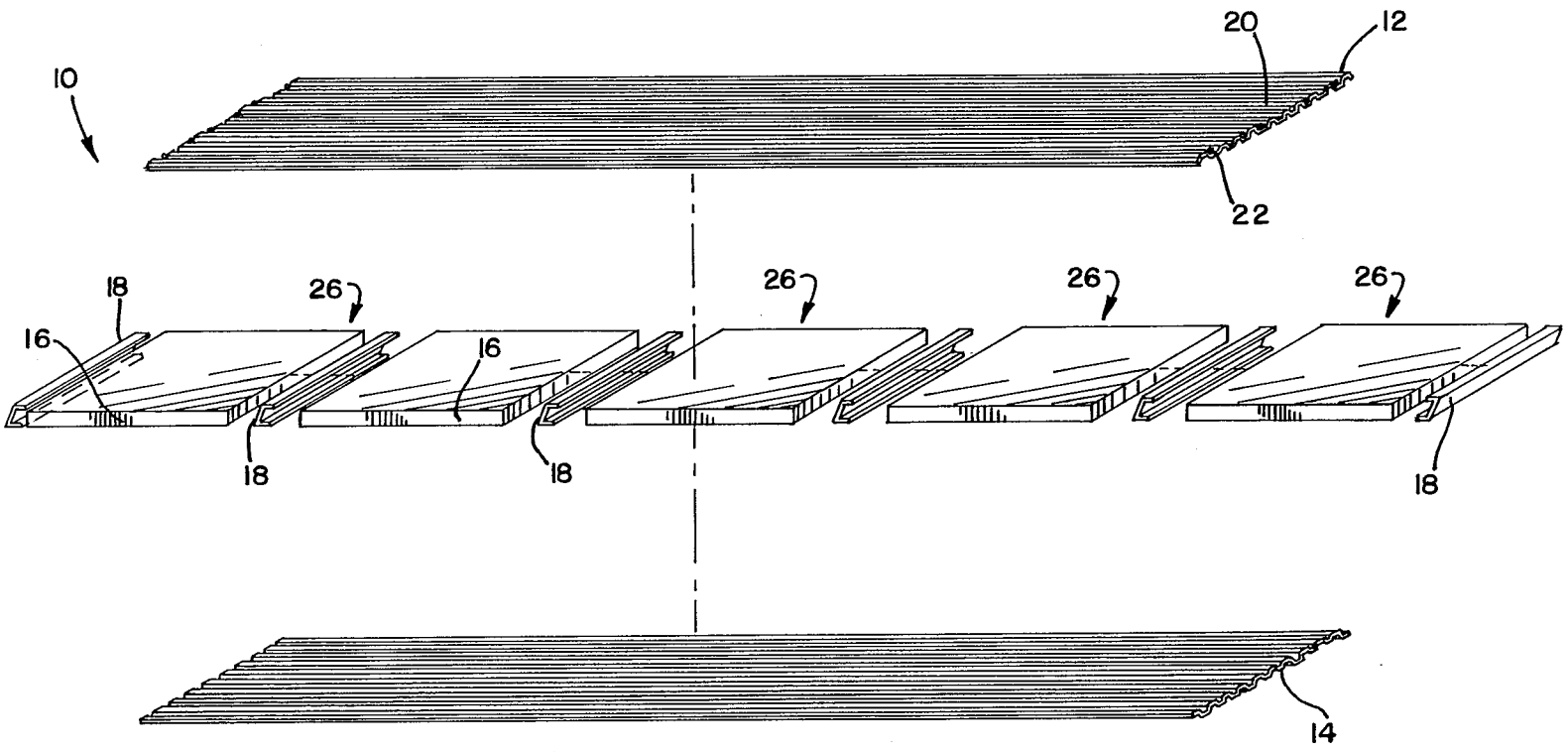
FIG. 2 is an exploded perspective view of my prefabricated building panel.
Figure 5:
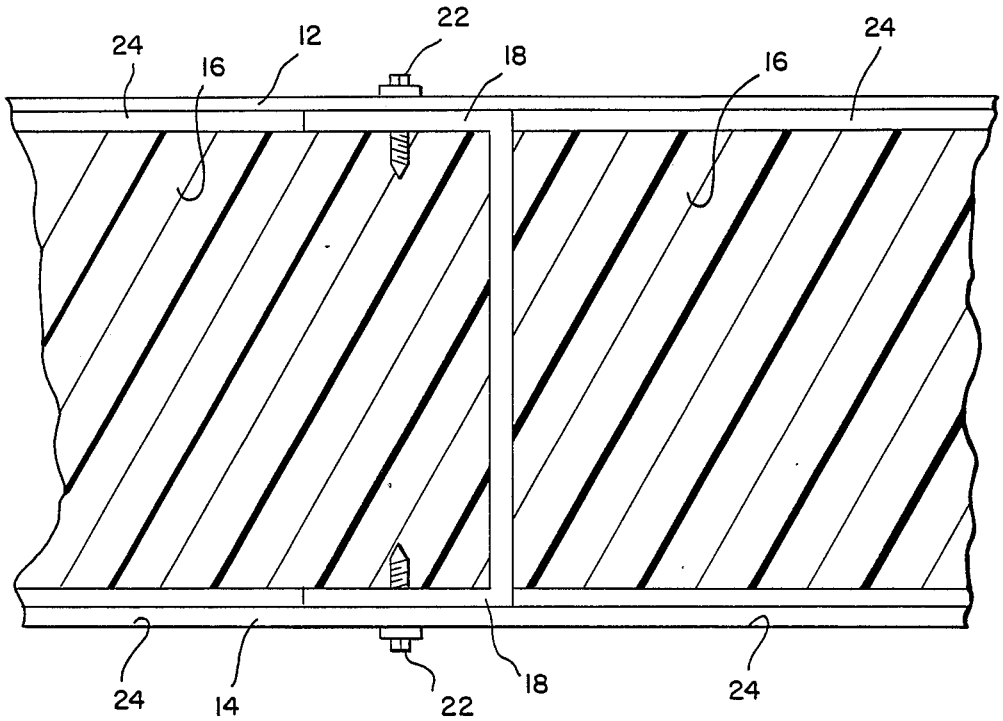

The placement of a series of pultrusions, as illustrated in FIG. 2, provides lateral support to the inner and outer skins and in effect, changes the section modulus of the panel making it more resistant to wind.

The panel 10 is comprised of one or more sections 26 as illustrated in FIG. 2. In my preferred embodiment, section 26 is approximately three feet by four feet; the thickness of the center core being three inches. These dimensions may vary without departing from the spirit and scope of my invention.

The panel 10 has a pultrusion 18 at each end. The section 26 are coupled together when the inner and outer skins are coupled to the pultrusions; each section 26 being comprised of a pultrusion 18 and a three foot by four foot by three inch center core. The center core panels abut each other whereas the corrugation from each adjacent panel overlap each other. A continuous length of butyl tape 28 is positioned between the overlapping corrugations providing a caulk, thereby sealing the corrugations from outside moisture and air. A stitching screw 22 or other suitable type fastener is used to connect the overlapping corrugations through the butyl tape caulk.

If the prefabricated panels are used for walls, the corrugations run vertically whereas if the prefabricated panel is used as a roof, the corrugations run from top to bottom of the roof.

It is understood that the above described panel is simply illustrative of the application of principles of my invention, and many other modifications, including the use of other materials may be made without departing from the spirit and scope of the invention.

I claim:

1. A prefabricated building panel suitable for use as a wall panel and a roof panel, said building panel comprising;

a center core;

a pultrusion coupled to the center core;

an inner skin coupled to the pultrusion forming an envelope of air between the center core and the inner skin;

an outer skin coupled to the pultrusion forming an envelope of air between the center core and the outer skin;

a vapor barrier formed by the circulation of air created in the air envelope between said inner skin and center core and between said outer skin and center core; said circulation of air occuring as the warmer air within said air envelope rises and the cooler air therein falls.

2. A prefabricated panel as set forth in claim 1 wherein said center core is comprised of styrofoam non-combustible mineral wool insulation.

3. A prefabricated panel as set forth in claim 1 wherein said center core is comprised of a combination of polystyrene foam and non-combustible mineral wool insulation.

4. A prefabricated building panel as set forth in claim 3 wherein the pultrusion is comprised of fiberglass in a "C" channel configuration.

5. A prefabricated building panel as set forth in claim 3 wherein the pultrusion is comprised of fiberglass in an "I" beam configuration.

6. A prefabricated building panel as set forth in claim 3 wherein said inner and outer skins are corrugated metal panels.

7. A prefabricated building panel as set forth in claim 6 wherein an additional skin suitable for interior use is coupled to the inner skin.

8. A prefabricated building panel as set forth in claim 7 wherein an additional skin suitable for exterior use is coupled to the outer skin.

9. A prefabricated building panel as set forth in claim 1, wherein said center core is comprised of polystyrene foam.

* * * * *

UNITED STATES PATENT AND TRADEMARK OFFICE

CERTIFICATE OF CORRECTION

PATENT NO. : 4,837,999

DATED : June 13, 1989

INVENTOR(S) : Vance Stayner

It is certified that error appears in the above-identified patent and that said Letters Patent is hereby corrected as shown below:

Column 1, lines 49, 54 & 56 delete the word "Styrofoam"

Column 3, line 23, after "styrofoam" insert --or--

Column 5, line 8 delete the word "Styrofoam".

Signed and Sealed this

Thirteenth Day of March, 1990

*Attest:*

JEFFREY M. SAMUELS

*Attesting Officer*

*Acting Commissioner of Patents and Trademarks*